US008926121B2

(12) United States Patent
Wu

(10) Patent No.: US 8,926,121 B2
(45) Date of Patent: Jan. 6, 2015

(54) PORTABLE LIGHT WITH SPECTRUM CONTROL MEANS

(71) Applicant: Youjin Wu, Westland, MI (US)

(72) Inventor: Youjin Wu, Westland, MI (US)

( * ) Notice: Subject to any disclaimer, the term of this patent is extended or adjusted under 35 U.S.C. 154(b) by 0 days.

(21) Appl. No.: 13/769,103

(22) Filed: Feb. 15, 2013

(65) Prior Publication Data

US 2014/0232262 A1 Aug. 21, 2014

(51) Int. Cl.
*H05B 33/08* (2006.01)

(52) U.S. Cl.
CPC ..... *H05B 33/0857* (2013.01); *H05B 33/0863* (2013.01)
USPC ..... 362/231; 362/184

(58) Field of Classification Search
USPC ..... 362/231, 184, 205
See application file for complete search history.

(56) References Cited

U.S. PATENT DOCUMENTS 1,613,203 A * 1/1927 Shannon ..... 340/321
1,946,059 A * 2/1934 Buchholz ..... 362/184
6,016,038 A 1/2000 Mueller et al.
6,095,661 A 8/2000 Lebens et al.
6,357,893 B1 3/2002 Belliveau
7,293,893 B2 11/2007 Kim et al.
7,422,344 B2 9/2008 Wu et al.
7,547,113 B2 * 6/2009 Lee ..... 362/231
7,896,518 B2 3/2011 Holmes et al.
7,988,318 B1 * 8/2011 Smith et al. ..... 362/187
8,111,023 B2 2/2012 Sun et al.
2007/0153513 A1 * 7/2007 Lin ..... 362/231
2007/0268150 A1 * 11/2007 Fraser ..... 340/815.63
2009/0237920 A1 * 9/2009 Dallas et al. ..... 362/184
2011/0163698 A1 * 7/2011 Spartano et al. ..... 315/362

* cited by examiner

*Primary Examiner* — Laura Tso

(57) ABSTRACT

A portable light with spectrum control means which allows the user to adjust the output spectrum manually and conveniently. The portable light includes compact housing with waterproof design and excellent heat dissipation, and it is preferably powered by batteries. A light source with multiple light-emitting units is aligned with light mixing and projecting components to produce light with uniform and consistent output synthetic spectra. Peripheral components, such as tactile switch, potentiometer, etc., and the electrical control circuit work together to respond to the user's actions to adjust the spectrum of the output light. The power management module regulates the electrical output of the power source to maintain a consistent light output as the power source drains.

19 Claims, 10 Drawing Sheets

PORTABLE LIGHT WITH SPECTRUM CONTROL MEANS

CROSS-REFERENCE TO RELATED APPLICATIONS

This application claims the benefit of provisional patent application Ser. No. 61/654,546 filed 2012 Jun. 1 by the present inventor.

FEDERALLY SPONSORED RESEARCH

None.

SEQUENCE LISTING

None.

TECHNICAL FIELD

The disclosure relates to a portable lighting device for generating light with manually adjustable spectrum.

BACKGROUND

Illumination is essential to human civilization and it has very long history. The material, energy efficiency and illumination quality evolve with technology. Today electricity is the primary energy form for illumination. About 20% of the electricity power in the world is used for illumination. Comparing to commercial lighting, industrial lighting and other fields, portable lighting is a relatively small market in illumination. But people still have persistent needs for portable lighting in many areas, such as outdoor sports (hiking, camping, hunting), residential activities (security, back-up lighting), law enforcement and military (night patrol, special operations), industry (machine maintenance, part inspection), etc. The annual revenue of portable lighting businesses in US is more than 4 billion dollars now, which keep tens of thousands of people employed. And there is still plenty of room for innovations and improvements in the product design of portable lights.

The major categories of portable light include flashlight, lantern, headlamp, bicycle light, etc., within which flashlight is the biggest and dominant category. Flashlight usually covers the portable lights that are powered by batteries with handhold body for projecting light to a specific direction. Its power source could be non-rechargeable batteries, such as AA, AAA alkaline models or CR123 Li—Mn model, or rechargeable batteries, such as 18650, 14500 lithium-ion models, etc.

The types of light source of portable lights include incandescent light bulbs, light-emitting diodes (LED) and gas discharge lamps. LED is becoming more and more popular recently for its higher efficiency, longer life, better stability and adjustability. However it also has drawbacks. LED requires driving and protection circuits to work which increase the cost. And as the brightness increases, the tiny LED chip generates lots of heat which requires proper heat dissipation structure. And in addition, the control of the light color or spectrum of LED has to be handled carefully.

LED has the feature of generating very narrow color spectrum, whereas the traditional light sources such as tungsten lamp can generate continuous spectrum over the full range of the visible light wavelength. People have to mix the different single-color lights generated by LEDs to produce white light that is suitable for daily illumination. The most common way is using a green-light LED chip (i.e. InGaN) on a phosphor substrate. The green light from the LED combines with the stimulated yellow light from the phosphor to provide the white color output. By adjusting the ratio of the individual colors, people can tune the output color to the specific correlated color temperature with satisfactory color rendering index.

On the other hand, by combining the basic color lights, such as red, green and blue, we can generate any visible light color on the CIE chromaticity diagram, not only the white light. While the technique of colorful illumination is widely applied in other fields such as architecture lighting, it's also desirable in portable lighting. For outdoor users, red light is preferred for reading maps in dark environment, blue light is better for tracing blood and green light is welcomed by hunters as it cannot be seen by some big games. Besides, people may just want to have different colors of light due to different individual preference, mood or environment.

For the same user, his/her mood, the environment and application vary over time. Therefore, it is desirable to have a portable light for which the light color can be changed by the user conveniently instead of being preset by the manufacturer.

LED or other solid-state light emitting devices can not only generate visible light but also infrared and ultraviolet lights. By the same method of mixing different basic colors in visible light, we can compose synthetic spectra from the individual light sources. Therefore, the output spectrum can be controlled to suit people's special need.

U.S. Pat. No. 7,293,893 (Paul Kim, 2004) discloses a flashlight that includes at least two different output wavelengths in addition to the primary light source. And U.S. Pat. No. 7,896,518 (Danny Holmes, 2008) describes a LED flashlight that produces at least three different colors and is operated by two separate switches. Both the two inventions bring additional colored lights into a flashlight in addition to the common white color light. However, they didn't mention the combination of different colors to generate other colors and the control means of their design are separate switches that work as function/color selectors. As the conclusion, the manipulation of colors in the two prior arts is limited to selection of basic colors instead of adjusting the output light color in the full-color range and in a stepless manner.

U.S. Pat. No. 6,016,038 (George Mueller, 1997) and its related patents assigned to Color Kinetics, Inc. describe the way of controlling LEDs to alter the brightness and color of the generated light. Along with their success in business, their invention has been applied in architecture illuminations and other areas. But none of the core elements of a portable light that allows the user to adjust color conveniently were included in their disclosure due to the difference between a portable light and architecture lighting systems.

First, a portable light (including flashlight) has very compact size for every day carry in pocket or handbag. If in cylindrical shape, its diameter is usually less than one inch which would be at least five times smaller than a regular architecture light. The circuit board of a flashlight is typically of the size of a quarter-coin which is difficult to design in order to maintain high energy efficiency. Thus the system oriented for architecture lights won't suit the portable lights automatically.

Second, a portable light is usually powered by batteries and so the electrical circuit system must take a very different form to that of the architecture lights which are connected to the 110V electricity network. The output voltage of a battery varies as it drains and a set of batteries can usually only support the flashlight for a few hours before they are drained up. As the working voltage of LEDs of different colors are different (for red color it's usually much lower than green and blue), if the voltage applied on the LEDs is decreasing, people will see the output color becomes weaker and more yellowish. Therefore, the power management is one of the biggest challenges in developing a portable light with color adjustability while it's not an issue for cabled lighting device.

And the last, the working range of the two illuminations are different. The architecture light usually sheds lights onto objects sitting far away from the light, typically beyond one yard. The portable lights would penetrate far distances up to hundreds of yards in special applications but mostly they have to illuminate very close targets such as within one foot. As the target is closer, the spatial color discrepancy would be more visible. Therefore, for the portable light with color adjustability, the different basic colors should mix more uniformly and thoroughly to avoid rainbow-type color deficiency. It requires special optical design.

SUMMARY

A portable light with spectrum control means is disclosed. The portable light includes the necessary housing structures and power source.

The portable light also has a light source which includes multiple light-emitting units which could be LED, OLED or other solid-state light emitting devices. The individual light-emitting units produce specific spectrums which are considered as basic spectrums for combining to generate synthetic spectra.

And the portable light also includes peripheral components such as tactile switches, potentiometers, etc. mounted on the light body. And there is electrical circuit inside the light which responds to the user's actions on the peripheral components and sends control signals to the light source. The system allows the user to adjust the synthetic spectra of the output light manually and conveniently by controlling the intensity of the individual basic spectrum.

The portable light further includes power management module which regulates the electrical energy from the power source to suit the working voltage and current of the light source. And the power management module works in a way that the output synthetic spectra power distribution will stay stable and consistent as the power source drains.

The portable light also includes optical module for mixing the basic lights uniformly and thoroughly and minimizing the spatial distribution difference on the illuminated object.

In visible light range, the said portable light has the advantages of manual full-color adjustability, color stability, high energy efficiency, minimum spatial color discrepancy and compact physical size. And the similar advantages also apply if the light-emitting units generate not only visible lights but also infrared and ultraviolet lights, which are adjustable power distribution, stability and minimum spatial discrepancy of the output synthetic spectra.

State-of-the-art technologies are applied in a practical way in the development which facilitates cost-effective mass production to make the versatile portable light very much affordable to the users. The advantages and innovations of the disclosed apparatus and method will become apparent from a study of the following description and the accompanying drawings.

DESCRIPTION OF THE DRAWINGS

The disclosure will now be described, by way of example, with reference to the accompanying drawings, in which.

DETAILED DESCRIPTION

The figures illustrate an exemplary implementation of a portable light with spectrum control means. Based on the foregoing, it is to be generally understood that the nomenclature used herein is simply for convenience and the terms used to describe the invention should be given the broadest meaning by one of ordinary skill in the art.

Figure 1:
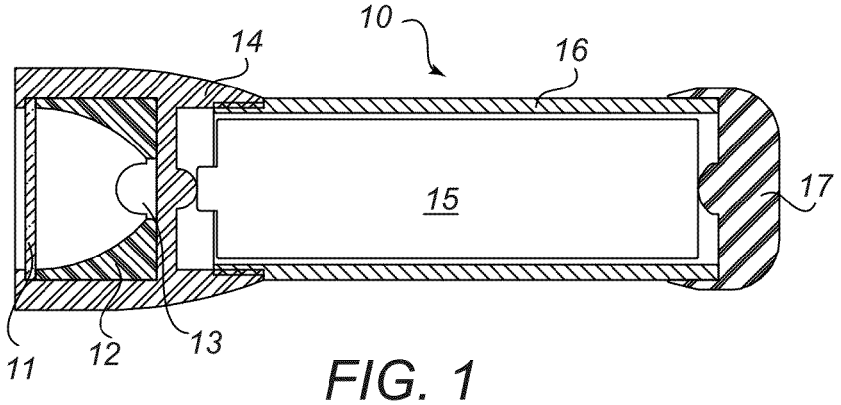
FIG. 1 is a sectional view of an ordinary flashlight related to the exemplary portable light, listed here for demonstration purpose, which can be considered as prior art.

FIG. 1 is a sectional view of an ordinary flashlight related to the exemplary portable light in prior art, listed here for demonstration purpose. A flashlight 10 comprises a lens 11, a reflector 12, a light source 13, a bezel 14, a battery 15, a body 16 and an end cap 17. The end with the lens 11 is usually referred to as the head end of the flashlight, and the opposite end is considered as the tail end. The lens 11 is transparent and allows the light to pass, which could be made from glass or plastics, such as PC or ABS, etc. The reflector 12 has an inner parabolic surface which reflects and condenses the light from the light source to a highly condensed light beam. The bezel 14 serves as the housing for the components at the head end. And the body 16 is a cylindrical tubular member containing the battery 15 and connecting the head end to the tail end. And the body 16 also serves the function of conducting electrical current from the end cap 17 to one of the electrodes of the light source. The body 16 is preferably made from conductive materials, such as aluminum extrusion or stamped steel, etc. If it's made from plastics, usually metal strips will be bonded to its inner wall to close the circuit. Most commonly the bezel 14 and body 16 are connected in a permanent manner, and the body 16 and end cap 17 are connected in a separable manner such as threading. Removing the end cap 17, the battery 15 can be replaced or removed. When the end cap 17 is loosened, the circuit is cut off and the light is off. When the end cap 17 is tightened, the circuit is closed and the light is on.

The paragraph above illustrates the structure and operation of an ordinary flashlight in prior arts which can only produce one type of light. With improvements from the basic platform, one of the exemplary embodiments of the portable light with spectrum control means will be described.

Figure 2A:
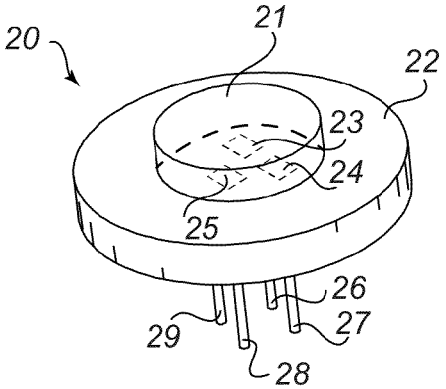
FIG. 2A is a perspective view of an exemplary light source with multiple light-emitting units, which can be considered as prior art.
Figure 2B:
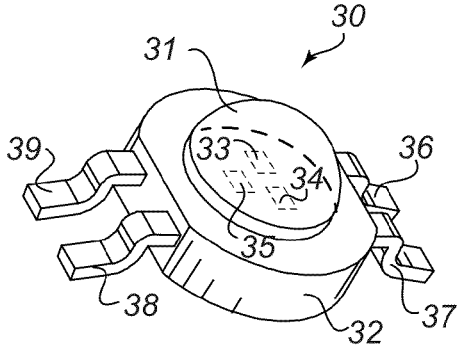
FIG. 2B is a perspective view of another exemplary light source with multiple light-emitting units, which can be considered as prior art.

The light source 13 in FIG. 1 is usually an incandescent light bulb or a LED. And it can only generate one type of light in the preset color. FIG. 2A and FIG. 2B illustrate the more advanced LED bulbs which include multiple light-emitting units in the single package. They only enter into existence in recent years and have been illustrated in prior arts. The LED 20 in FIG. 2A takes the so-called DIP form which includes a flat round metal tray 22, epoxy lens 21, long legs 26, 27, 28 and 29, and light-emitting chips 23, 24 and 25. The LED 30 in FIG. 2B takes surface-mounting (SMD) form which includes a flat plastic base 32, dome lens 31, angled legs 36, 37, 38 and 39, and light-emitting chips 33, 34 and 35. The LED 30 can be mounted onto the circuit board by automation process, while the LED 20 may only be manually assembled to the circuit board. However, the LED 20 has the advantage of better heat dissipation, which is preferred in high-performance portable lighting.

While the number of individual light-emitting units in LED 20 and 30 and their respective spectrums can be configured in different ways, it's a common way to use the red, green and blue as the three basic colors in visible light range. It's well known in the art that by combining red, green and blue, most of the colors on the CIE chromaticity diagram can be generated. Therefore, a LED bulb including red, green and blue chips is usually called full-color LED or RGB LED. To enhance the color rendering performance, some people put other colors in the package, such as amber, yellow, etc. in addition to the three basic colors.

Although, the red, green and blue colors are used as example in following illustration, the light-emitting units could have any wavelength in visible light, infrared or ultraviolet. The apparatus and method of the present invention can handle lights not only in visible light but also infrared and ultraviolet.

Figure 2C:
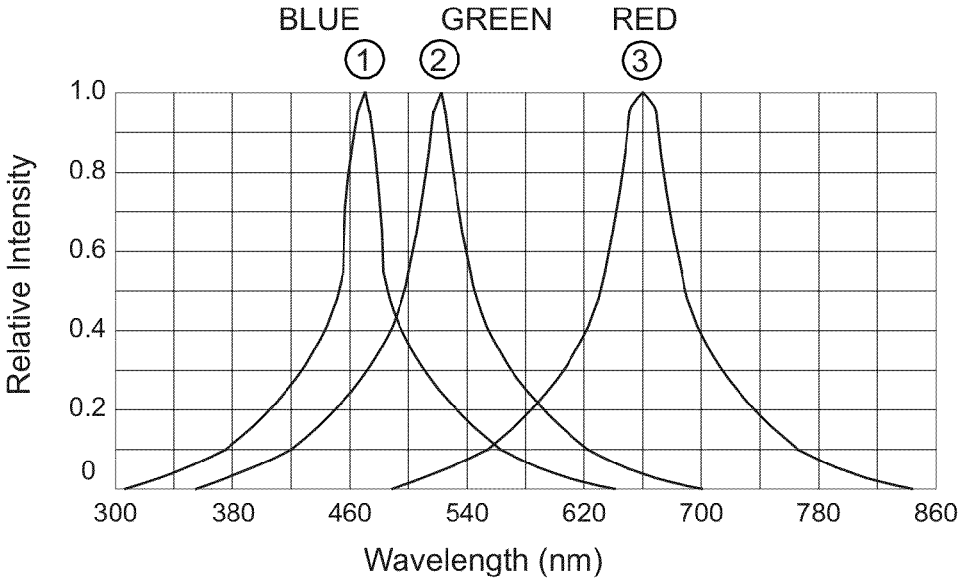
FIG. 2C is a graph illustrating the spectral power distribution of the three basic colors, which can also be considered as prior art.

FIG. 2C is a graph illustrating the spectral power distribution of the red, green and blue light-emitting units. The red light covers the wavelength from 490 nm to 840 nm with its peak at 660 nm, the green light covers the wavelength from 360 nm to 700 nm with its peak at 520 nm, and the blue light covers the wavelength from 310 nm to 640 nm with its peak at 470 nm. And their individual luminous flux could be adjusted between 20 lumens and 70 lumens. The three basic light-emitting units can work together to produce the desired light color. Even though the preferred embodiment will be introduced with LED 20 with embodiment of FIG. 2A and luminous feature of FIG. 2C, they should be apprehended for exemplary purpose and for the convenience of illustration and be given the broadest meaning by one of ordinary skill in the art. None of them should be a limitation of the invention.

Figure 3:
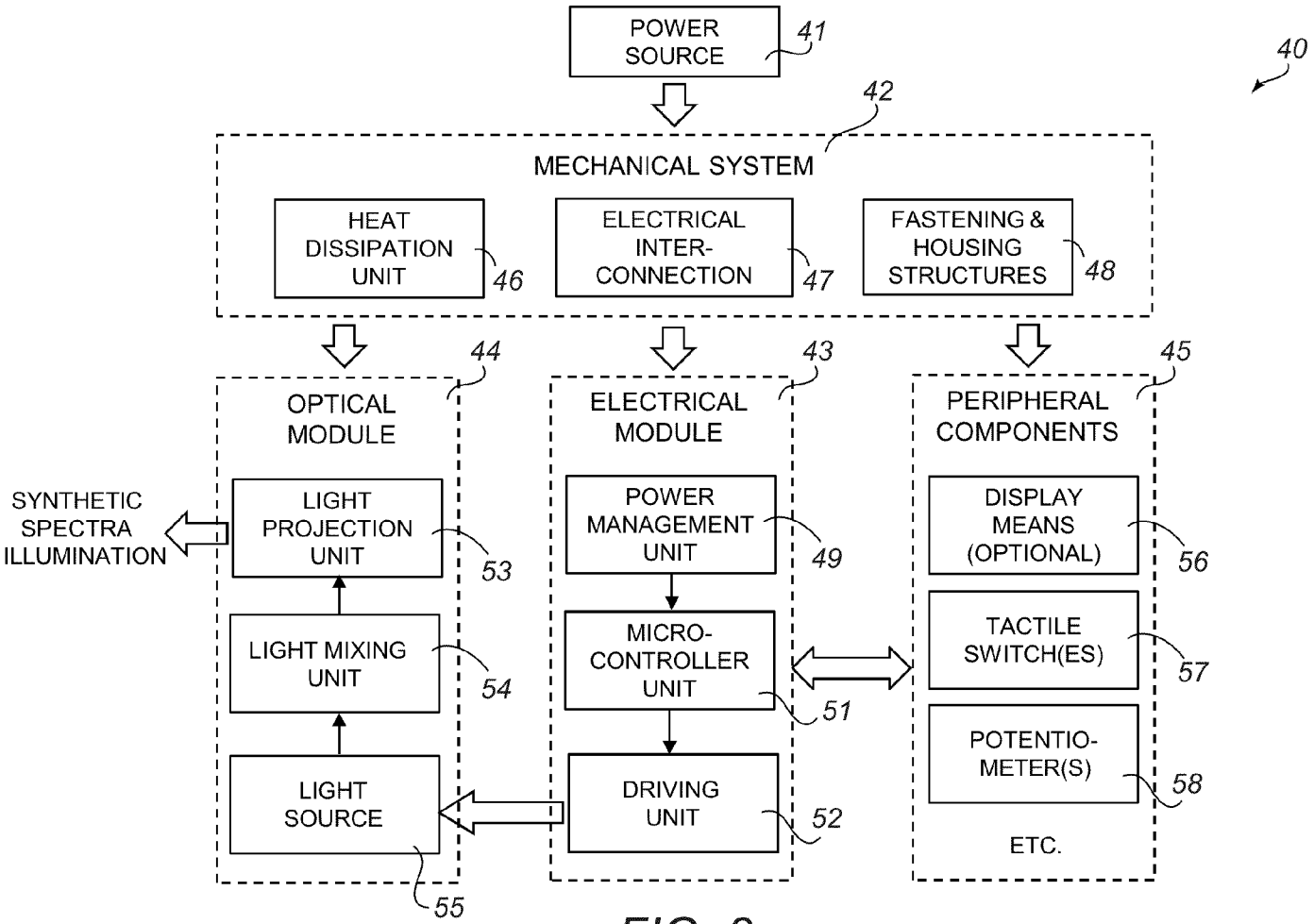
FIG. 3 is a block diagram of the exemplary portable light of the invention.

FIG. 3 is a block diagram of the exemplary portable light with spectrum control means. The portable light 40 includes a power source 41, mechanical system 42, electrical module 43, optical module 44 and peripheral components 45. The mechanical system 42 comprises heat dissipation unit 46, electrical interconnection 47 and fastening & housing structures 48. The electrical module 43 includes power management unit 49, micro-controller unit 51 and driving unit 52. The optical module includes light source 55 which includes multiple light-emitting units, light-mixing unit 54 and light projection unit 53. And the peripheral components consist of tactile switch 57, potentiometer 58 and display means 56.

The defined modules and units here should be understood as functional blocks for the convenience of illustration instead of physical components. The same physical component may bare more than one functions, while different components may work for the same function.

The mechanical system provides the physical housing for the electrical parts, optical parts and the power source. The power source 41 is connected to the power management unit 49, which regulates the output of the power source 41 to provide the proper voltage and current for the other electrical units. The micro-controller unit 51 receives the input from the peripheral components and sends signals to the driving unit 52. And the driving unit 52 serves as the interface between the light source 55 and the micro-controller unit 51. The output light from the light source 55 enters the light mixing unit 54 and light projection unit 53, and then exits the portable light to provide high-quality illumination with synthetic spectra distribution. The potentiometer 58 may also be replaced by other components with similar function such as a magnetic sensor, etc. The display means 56 is optional because as shown in following illustration of the preferred embodiment, the operation status of the system can be shown by the output light in a well-designed way. By omitting unnecessary parts the system can be made lean and physically compact.

Figure 4A:
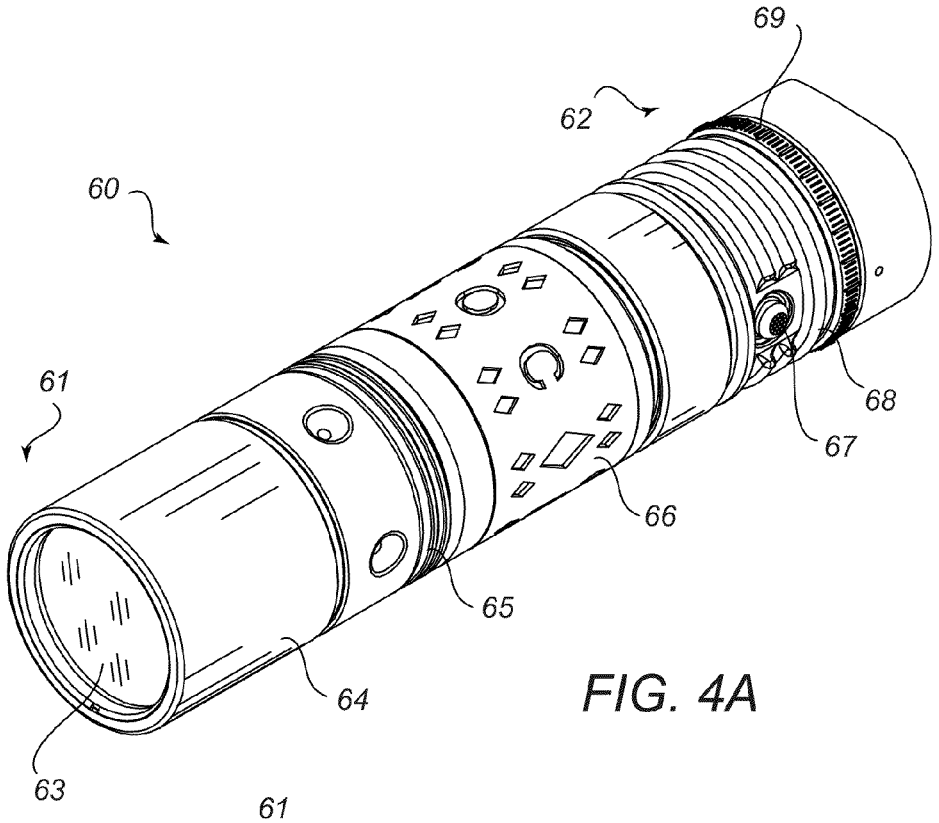
FIG. 4A is a left perspective view of a preferred embodiment of the invention.
Figure 4B:
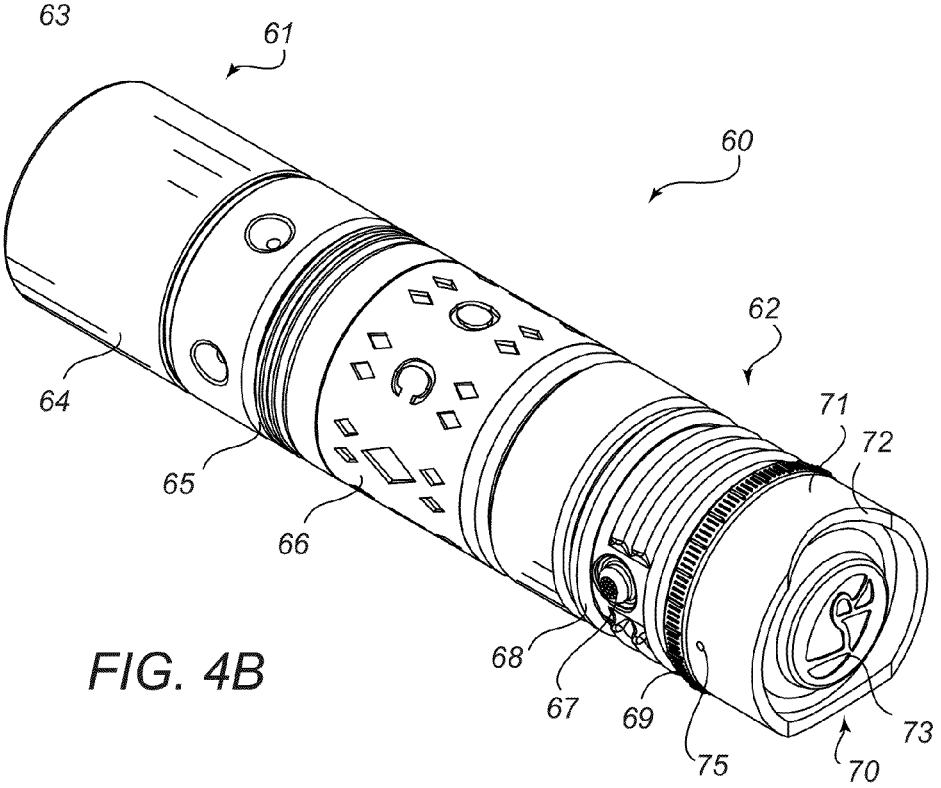
FIG. 4B is a right perspective view of the preferred embodiment of the invention.

FIG. 4A and FIG. 4B are the perspective views of a preferred embodiment of the invention. The flashlight 60 is a physical reduction of the system 40 illustrated in FIG. 3. The external features of the flashlight 60 are shown in FIG. 4A and FIG. 4B. The flashlight 60 has the head end 61 and the tail end 62. At the head end there is lens 63 from which the output light exits. The flat cylindrical portion 64 encloses the optical components which will be illustrated. And the groove array 65 behind the cylindrical portion 64 serves the heat dissipation function. In the middle there is a handhold portion 66. At the tail end, there is a cylindrical portion 68 which supports a button member 67 and a marking member 69. And in FIG. 4B, a rotatable member 70 is shown at the tail end which has cylindrical surface 71, cut-off portion 72 and flat end surface 73. On surface 71 there is a dot 75 for showing the orientation of the rotatable member 70. The rotatable member can be called as knob. A logo could be marked on the flat end surface 73. The functions of the components and the operation of the flashlight will be described in greater detail below.

Figure 5:
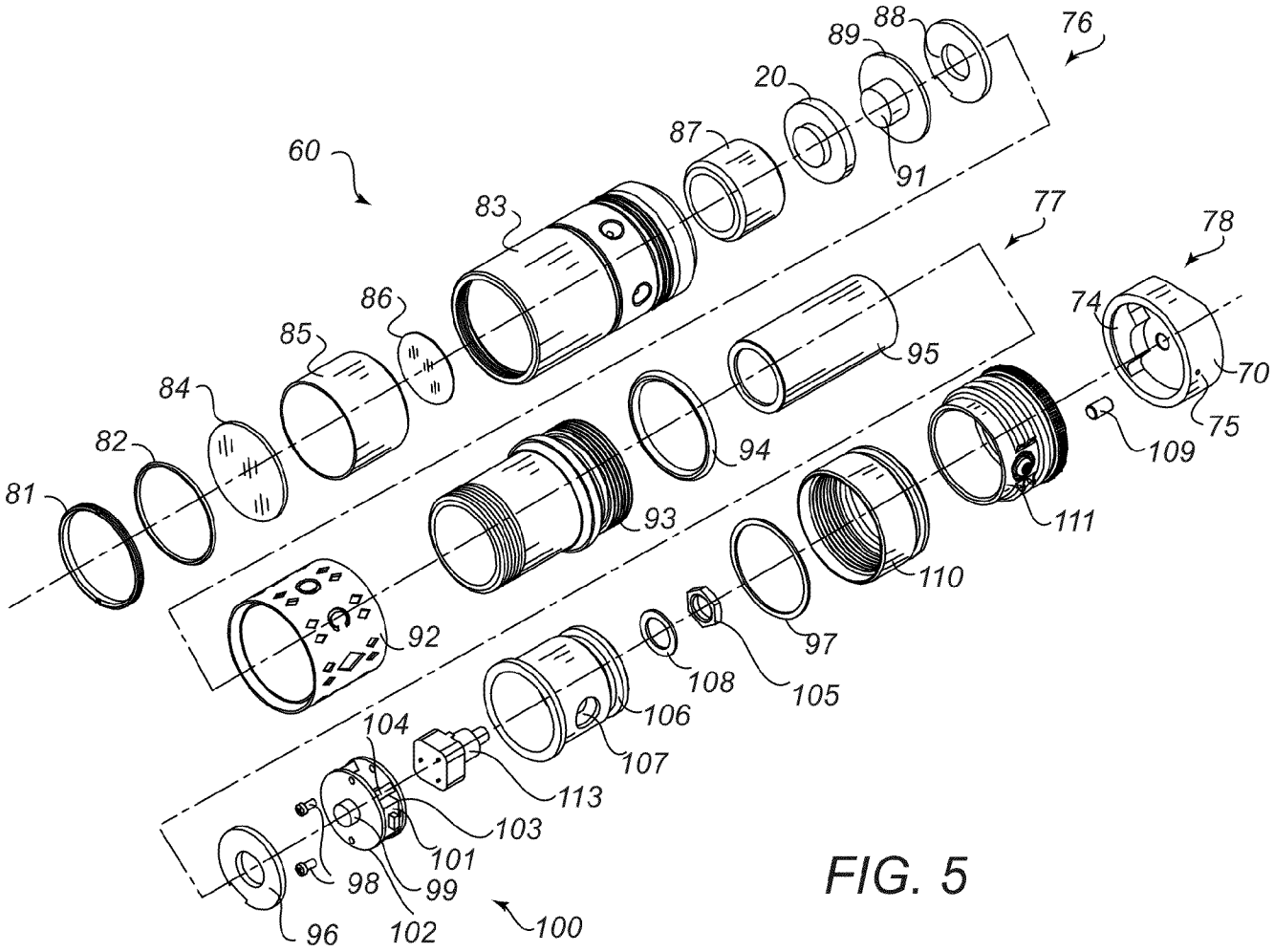
FIG. 5 is an exploded view of the preferred embodiment of the invention.

FIG. 5 is an exploded view of the exemplary flashlight 60. For the convenience of illustration, the components are divided into three groups by their physical location: the bezel section 76, body section 77 and end cap section 78. The bezel section 76 includes a retaining ring 81, a rubber o-ring 82, a housing 83, a lens 84, a reflector 85, a light-mixing lens 86, another reflector 87, a RGB LED 20, a circuit board 89 and a plate 88. The body section 77 includes a sleeve member 92, a housing 93, a rubber o-ring 94 and a battery 95. And the end cap section 78 includes a plate 96, 2 screws 98, a circuit board assembly 100, a potentiometer 113, a housing 106, a washer 108, a hex nut 105, a sealing washer 97, a connector 110, a cover 111, a pin 109 and a knob 70.

Figure 6:
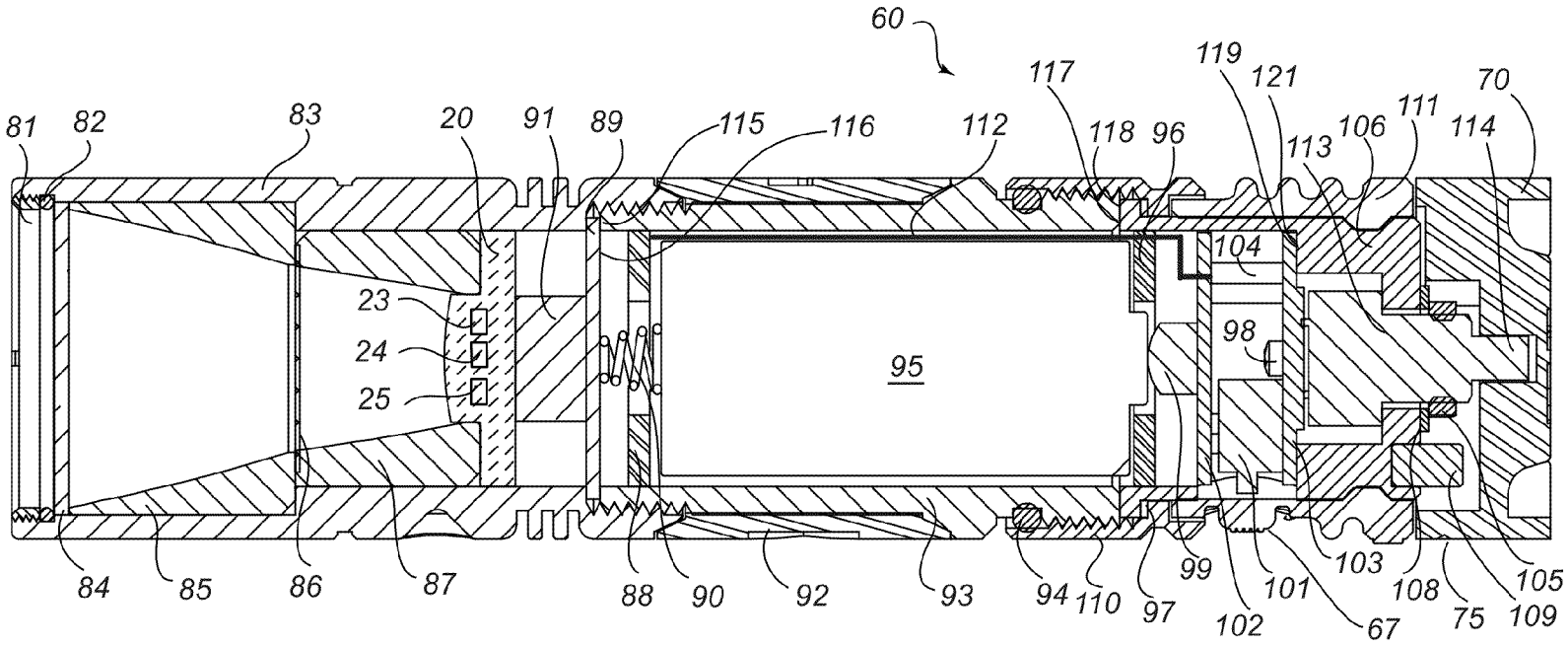
FIG. 6 is a sectional view of the preferred embodiment of the invention according to line 6-6 of FIG. 11.
Figure 11:
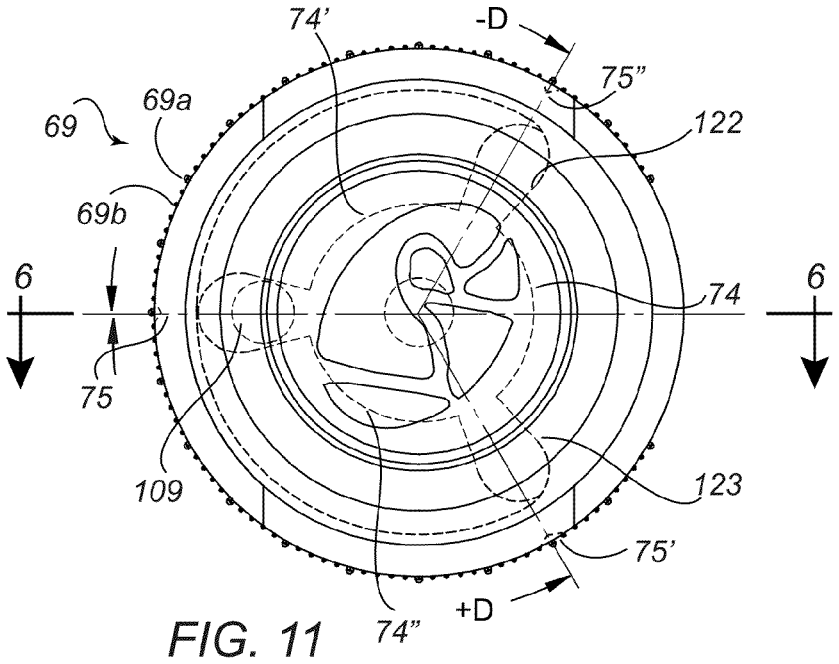
FIG. 11 is a side view illustrating the different positions of an adjustment member of the embodiment.

FIG. 6 is a sectional view of the exemplary flashlight 60 according to line 6-6 of FIG. 11, which clearly shows how the components in FIG. 5 are assembled together. The housing 83 is a cylindrical tubular part which serves as the enclosure of the components at the head end. The light-mixing lens 86, reflector 85, lens 84 and o-ring 82 fit into the inside of the housing 83 from the head end. And the retaining ring 81 locks the four parts in position by thread in a permanent and waterproof manner. The reflector 87, LED 20, spacer 91 and PCB 89 fit into the inside of the housing from the opposite side. The plate 88 covers the PCB 89 while it allows the spring 90 pass through a hole in center to contact the cathode of the battery 95. The plate 88 is made from insulated materials such as PMMA plastics, which can be bonded in position with glue.

The light-mixing lens 86 is tightly sandwiched by the reflector 85 and reflector 87. The basic lights with different spectrums from the light source 55 mixes through the light-mixing lens 86. The light exiting the light-mixing lens 86 has uniform and consistent spectrum power distribution. As a core part of the apparatus, the light-mixing lens 86 can take the form of a fly-eye lens, a planar lens with light scattering layer, or a light diffusion sheet. The design of this part should take the light transmission efficiency and light-mixing degree into consideration. Usually in order to have more uniformly mixed output light we get lower output intensity. For a fly-eye lens, it is usually made from plastics with high transparency such as PMMA or PC and by injection molding. And the light scattering layer on a lens or a diffusion sheet consists of light dispersion particles with the size from a few microns to hundreds of microns. And the particles are bonds to the base with transparent adhesives.

For better spatial uniformity of the output light spectrum, the inner reflective surface of the reflector 85 and 87 can be etched to have little concave and convex portions (so-called orange peel finish) before coating process.

The housing 93 is a cylindrical tubular member which connects the bezel section 76 to the end cap section 78. The battery 95 sits inside the housing 93 with its cathode facing the head end and the anode facing the tail end. In the preferred embodiment the battery 95 is preferred to be a CR123A Li—Mn battery with diameter 0.65 inch and length 1.34 inches. And the spring 90 is soldered on the PCB 89 and contacts the cathode of the battery 95. The sleeve member 92 fits over the recessed portion of the housing 93 for comfortable handholding and protection. The housing 83 and housing 93 are connected by thread and preferably processed with glue so that they cannot be detached or get loose.

The housing 106 is the base for the components in the end cap section 78. The connector 110 is a cylindrical member with inner thread at the head side and a shoulder portion at the tail side. The connector 110 is attached to the housing 93 by threading to connect the end cap section 78 with the rest of the flashlight. When the connector 110 is rotated, the whole end cap section 78 will move toward or away from the body portion 77. Thus the end cap section 78 can be locked or released. The cover 111 is preferably made from flexible materials such as rubber or plastics. It slides onto the external surface of the housing 106 and it is locked in position by engaging its inner rib with a recessed portion of the housing 106.

The circuit board assembly 100 consists of a PCB 102, another PCB 103, a tactile switch 101, an electrode 99 and 4 pillars 104. The PCB 102 and PCB 103 are both flat round circuit boards and they are connected by the 4 pillars 104 as an integral assembly. The circuit board assembly 100 is attached to the housing 106 by 2 screws 98. The housing 106 has a hole 107 which allows the action on the button member 67 to be conveyed to the tactile switch 101. The potentiometer 113 is mounted at the center of tail end of housing 106 with a washer 108 and a hex nut 105. And the potentiometer 113 has a shaft 114 engaging the knob 70 so that the rotation of the knob 70 will be rigidly conveyed to the potentiometer 113. A pin 109 fits on the tail end of the housing 106, parallel to the shaft 114. As the inner portion 74 of knob 70 interferes with the pin 109, the rotation of the knob 70 is confined to about ⅔ circle. The orientation of the knob 70 and the output of the potentiometer 113 is indicated by the position of the dot 75.

The housing 83, housing 93 and housing 106 are preferably made from conductive materials and further preferred to be aluminum. They could be machined from aluminum extrusion and there are anodized to have hard and insulated surface. To conduct the current, certain portions of the housings need to be machined after anodizing. In FIG. 6, the surface 115 of housing 93 contacts the surface 116 of PCB 89, the surface 117 of housing 93 contacts the surface 118 of housing 106, and the surface 119 of PCB 103 contacts the surface 121 of the housing 106. The contacts connect to the ground pole GND in FIG. 7. The surface 115 and surface 117 of housing 93, surface 118 and surface 121 of housing 106 should be machined after anodizing to be conductive. And the cable 112 connects the PCB 89 to circuit board assembly 100.

FIG. 6 shows the position of the components when the connector 110 is fully tightened and the circuit is closed. When the connector 110 is loosened, the tension from the spring 90 will push the end cap section 78 away so that the surface 117 and surface 118 lose contact and the circuit will be opened. Even though the system can be turned off in software as introduced later, physically cutting off the circuit is a better way of shutting down the system for power preserving.

The exemplary flashlight 60 is assembled to be waterproof. The o-ring 82, o-ring 94, rubber washer 97 and cover 111 prevent the water and moisture from entering the inside of the flashlight 60. The gap between the potentiometer 113 and through hole on housing 106 is sealed by compound material, such as silicone.

Figure 7:
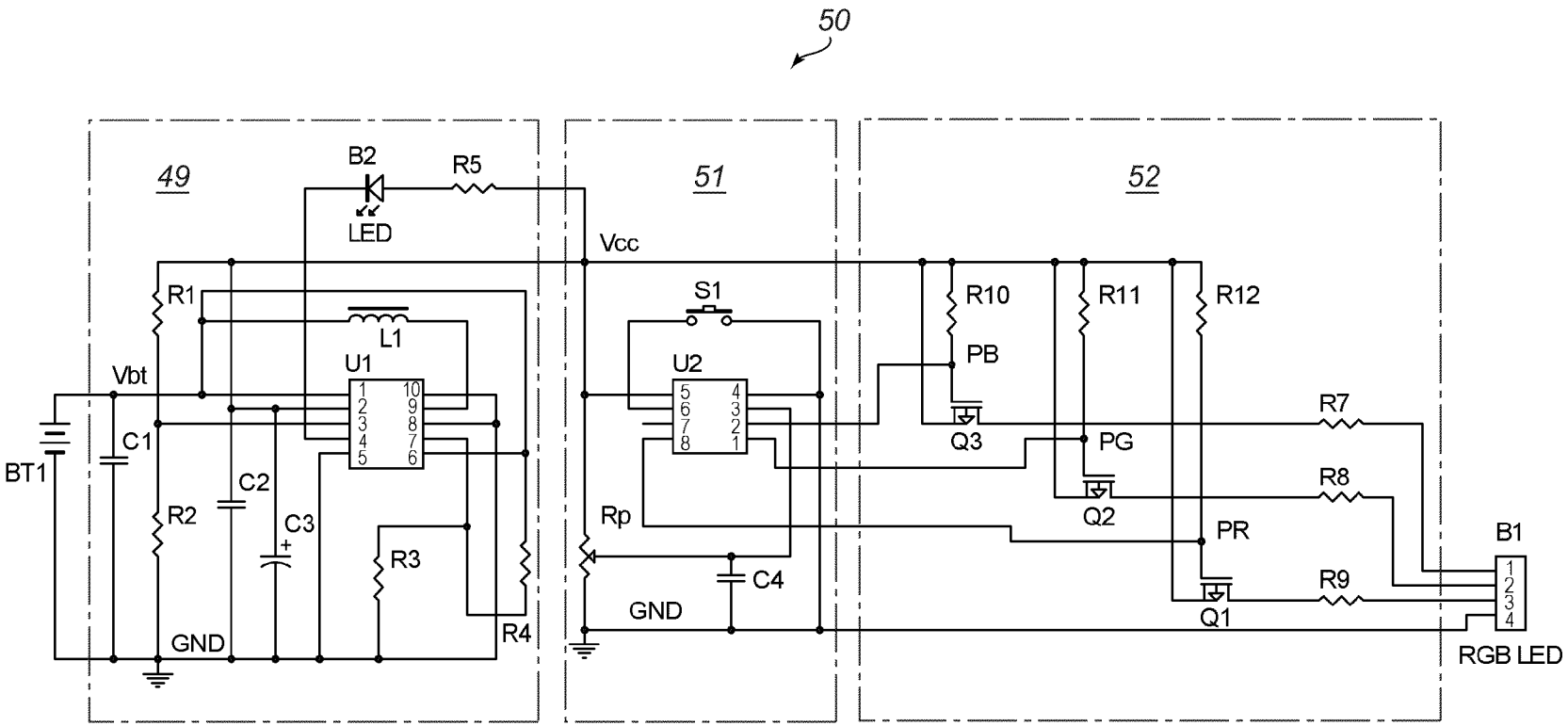
FIG. 7 is an electrical schematic diagram of the embodiment of FIG. 4-6.

FIG. 7 is an electrical schematic diagram of the exemplary flashlight 60. The electrical system 50 consists of a power management unit 49, micro-controller unit 51 and driving unit 52. It is powered by battery BT1 and drives the LED component B1. The core component of the power management unit 49 is an IC chip U1. And in one preferred embodiment, the IC chip U1 is the synchronous boost converter TPS61029 from Texas Instruments Inc. The chip accepts input voltage from 0.9V to 6.5V and provides output voltage between 0.5V and 5.5V. It has the high switch current up to 1.8 A. If a CR123 battery is used as the power source, in order to convert the 3V input voltage to 4V voltage to power the micro-controller unit 51 and driving unit 52, the programming resistor R2 could be 200K ohm and resistor R1 could be 1.4M ohm. An inductor L1 regulates the output current which could be 6.8 uH. The capacitors C1, C2 and C3 regulates the input and output voltages which could be either ceramic or tantalum capacitors with capacity from 4.8 uF to 47 uF. And the resistor R3, R4, R5 and LED B2 work as low battery indicator, which is optional.

The micro-controller unit 51 is based on an IC U2. There are different chips on the market that are suitable for the application, such as PIC series 8-bit microcontrollers from Microchip Technology Inc. It's preferred for the IC U2 to have at least 8 pins within which at least one pin is analog-digital convertor (ADC). And it's preferred that the IC U2 has at least one port interrupt channel and has sleep mode. A tactile switch Si is connected to pin-6 of the IC U2. The pin-6 could be programmed with pull-high feature so that if the switch Si is not depressed, the pin-6 input is high, and if the switch Si is depressed, the pin-6 input is low. A potentiometer is connected to pin-3 of the IC U2 which needs to be an ADC channel. The program could probe the analog input voltage of the pin-3 and convert it into digital data. The switch Si and potentiometer Rp serves as the interface between the user and the system. As shown later, the user could adjust the color, brightness and strobe of the output light by the switch and the potentiometer.

The driving unit 52 has 3 transistors Q1, Q2 and Q3 which receive the control signals PR, PG and PB from IC U2 respectively. The transistors could be P MOS field effect transistors. The control signals are applied on the gate poles of the transistors and the gate poles are pulled up by resistors R10, R11 and R12. When there is no input or the input is high, the transistor will be shut off and the specific color of the LED B1 will be off. When the input is low, the transistor will be turned on and the specific color of the LED B1 will be on. The resistors R7, R8 and R9 are selected to limit the current passing through the respective light-emitting units of LED B1. As the IC U2 works at very high frequency, the control signal PR, PG and PB can switch between low and high very fast. Therefore, pulse width modulation (PWM) control method can be applied, which will be illustrated in greater detail later.

Figure 8:
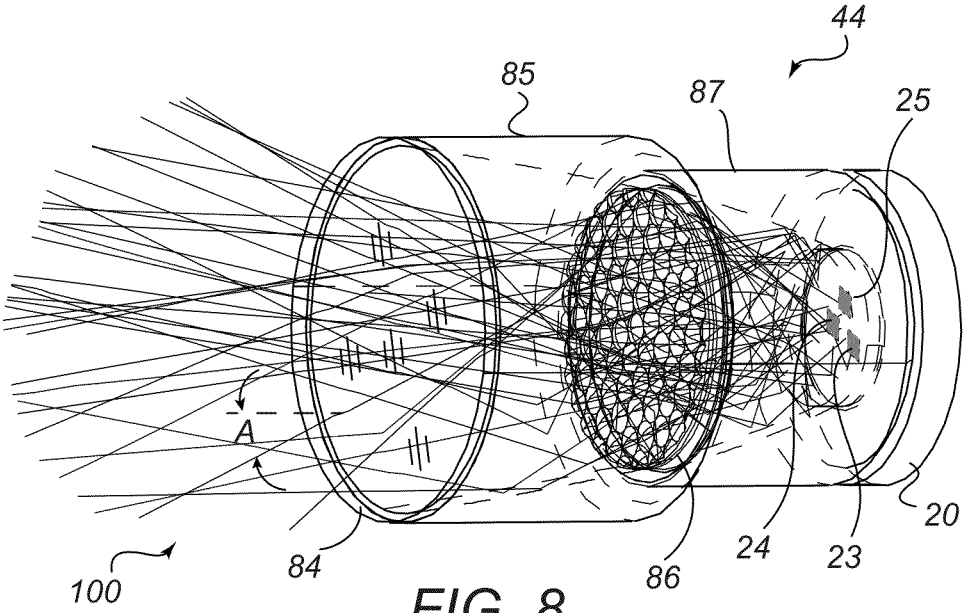
FIG. 8 is a perspective view of an exemplary optical module of the embodiment of FIG. 4-6 illustrating the trace of the light rays.

FIG. 8 is a perspective view of an optical module 44 of the exemplary flashlight 60, illustrating the trace of the light rays. The optical module 44 consists of a lens 84, a reflector 85, a light-mixing lens 86, a reflector 87 and LED 20. The multiple light-emitting units 23, 24 and 25 are located at different locations inside the light source 20. For convenience of illustration, the light-mixing lens 86 takes the forms of a fly-eye lens. As shown in FIG. 8, the light rays from different light-emitting units are mixed together in spite of their origin. Therefore the output light of the flashlight 60 has uniform spectrum power distribution. In visible light range, the output light has consistent color instead of showing different colors at different locations like a rainbow.

Figure 9:
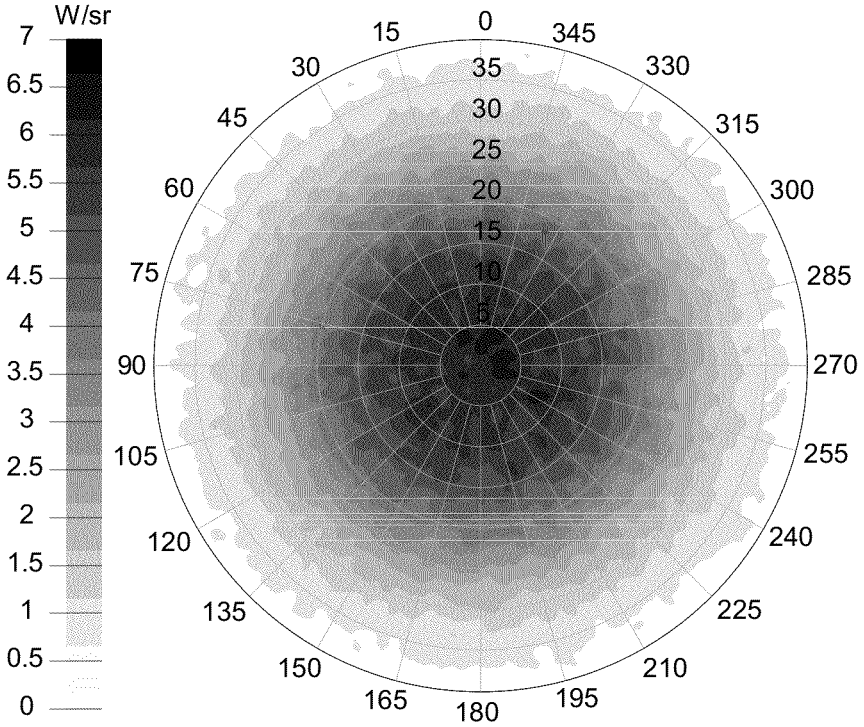
FIG. 9 is a graph illustrating the polar iso-candela distribution of the exiting light of the embodiment of FIG. 4-6.

FIG. 9 is a graph illustrating the polar iso-candela distribution of the exiting light from the lens 84 generated by ray trace software. The rays leave the lens at angle A in FIG. 8 which is shown in the center of FIG. 9 along the radial direction. And the transversal angle is shown around the circle. It shows that for exemplary flashlight 60, most of the light exits the light at angle less than 35 degrees and the half-intensity angle is about 20 degrees. Therefore, the divergence angle of the light beam is about 40 degrees. If the distance between the light and target is known, the size of the light spot can be calculated accordingly. By adjusting the dimensions of the optical components, the divergence angle can be adjusted to suit the specific applications.

Figure 10:
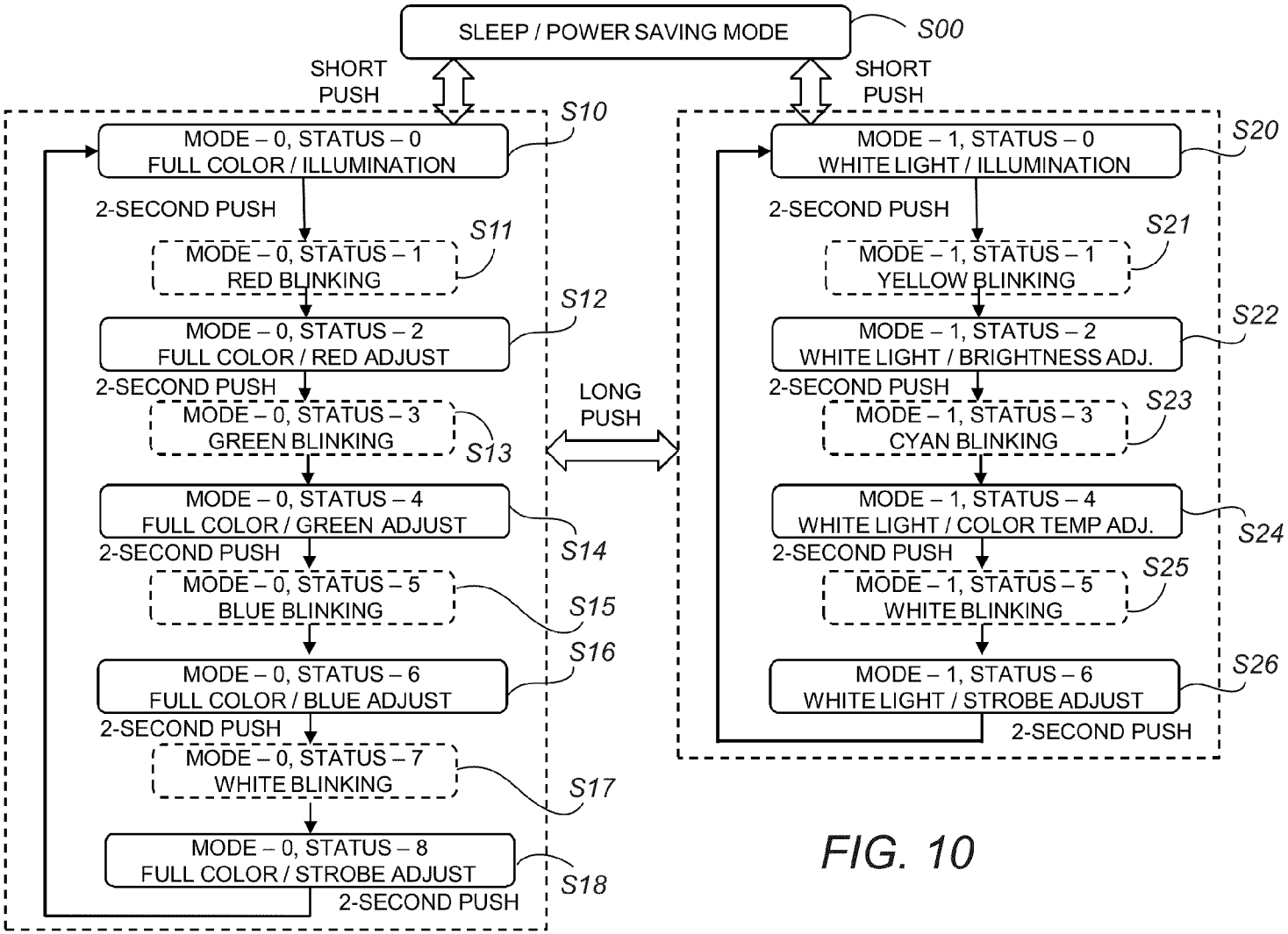
FIG. 10 is a logic flow diagram illustrating an exemplary method for operating the embodiment of FIG. 4-7.

With the mechanical, electrical and optical systems having been illustrated, FIG. 10 is a logic flow diagram illustrating an exemplary method for operating the flashlight. Once the circuit is closed, the system could be in sleep mode S00 or different working modes. If the system is in working modes, it could work in full color mode or white light mode and in each working mode there are different working statuses. When the system is in sleep mode S00, pressing the tactile switch 101 shortly (i.e. less than 1 second), the system will enter into full color illumination status S10 or white light illumination S20. Anytime when the system is in working modes, pressing the tactile switch 101 for a long time (i.e. longer than 3 seconds) will switch the system between full color mode and white light mode. In full color mode, the user is allowed to adjust the light output to any color on the CIE chromaticity diagram by adjusting the intensity of the red, green and blue colors sequentially. In white light mode, the light output will be white light in different color temperatures, and the user is only allowed to adjust the brightness and color temperature of the light output. By providing two different illumination modes, it gives the user the convenience to swiftly switch between colorful illumination and white light for different applications. Under the status S10 or S20, the light can be turned off by shortly pressing the tactile switch. However, if the light is not to be used for a long time, it's better to loosen the connector 110 to physically cut off the circuit in order to preserve power.

When the system is in full color illumination status S10, by pressing the tactile switch for about 2 seconds, the user will bring the system into adjustment statuses: red adjustment S12, green adjustment S14, blue adjustment S16 and strobe adjustment S18. Before entering each adjustment status, the system will be at transient status in which the output light will show the specific color and blink for certain time (i.e. 3 seconds) to notify the user of the current operating status of the system. For instance, before entering red adjustment status S12, the output light will turn to red and blink for 3 seconds and then automatically switch to the red adjustment status. In each adjustment status, the user can rotate the adjustment member 70 to change the voltage on the pin 3 of IC U2. And the system will adjust the light output real-time according to the user's action. Once the user is satisfied with the output, the user can press the tactile switch shortly (i.e. less than 1 second) to record the color data in memory. In strobe adjustment status, the strobe speed can be adjusted between no strobe and the fastest strobe speed. After the strobe adjustment status S18, the system will get back to the full color illumination status S10 with the saved output color. In white light mode, from white light illumination status S20, the operating procedures are similar to the operations in the full color mode. Instead of adjusting the intensity of the red, green and blue colors, the user adjusts the intensity and color temperature of the light output. To adjust color temperature, the program could adjust the ratio of the red color and blue color. With more red color, the output is warmer. With more blue color, the output is cooler.

FIG. 11 is a side view illustrating the different orientations of the knob 70. The knob 70 can be rotated by gripping the cylindrical portion 71 and aligning the dot 75 with the marking member 69 on the cover 111. In each adjustment status, rotating the knob 70 will change the light output real-time for the user to set up the color, brightness or strobe. The pin 109 serves as the stopper to the rotation of the knob 70. The rotation of the knob 70 is limited to less than one circle. When the wall 122 of the inner portion 74 hits the pin 109, the knob is at angle +D and the output voltage of the potentiometer is set to the highest so that the system will record it as the highest input. When the wall 123 of the inner portion 74 hits the pin 109, the knob is at angle −D and the output voltage of the potentiometer is set to the lowest so that the system will record it as the lowest input. And the light output can be adjusted accordingly. The marking 69 may further include major markings 69*a* and minor markings 69*b* to provide clear reference for the user.

Figure 12:
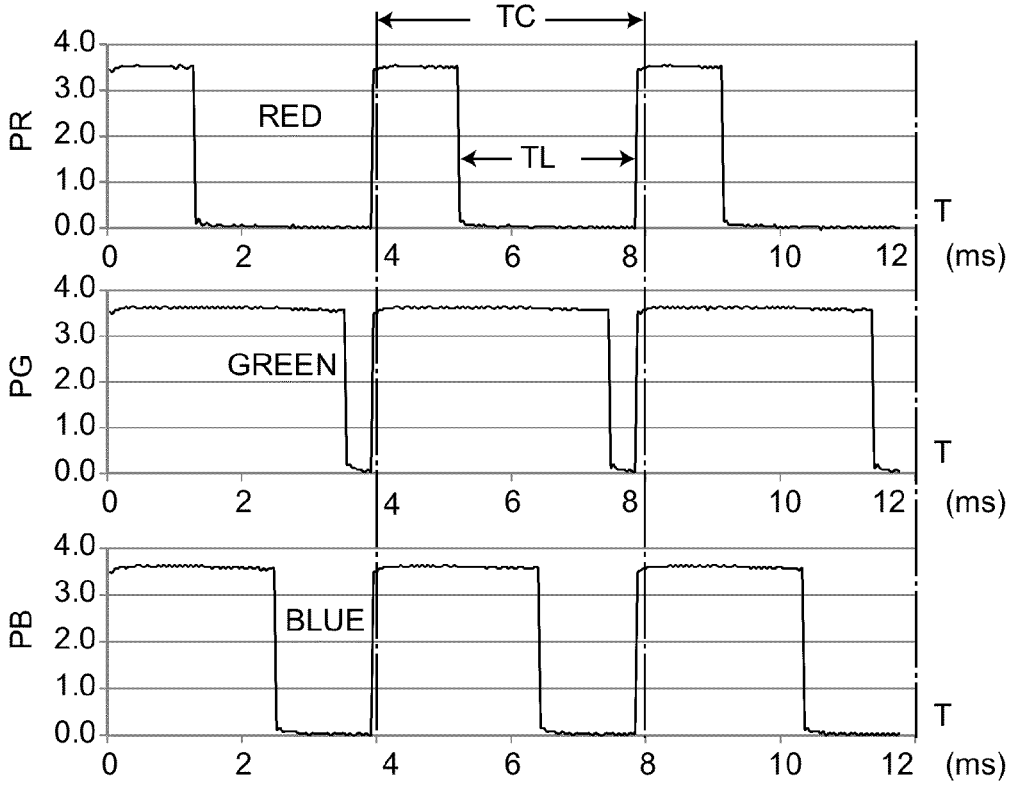
FIG. 12 is a graph illustrating the control signals the microcontroller unit sent to the driving circuit of FIG. 7

FIG. 12 is a graph illustrating the control signals that the micro-controller unit 51 sends to the driving unit 52. PR, PG and PB are digital voltage signals which switch between high and low. The well-known PWM control method can be applied. The brightness of the light output of the specific light-emitting unit is controlled by the duty cycle of the PWM signals. The longer time the signal stays low, the brighter the light output is. According to one preferred embodiment, the cycle TC is about 4 ms. Therefore, the PWM frequency is about 250 Hz. Under the frequency the blinking of the LED cannot be noticed by human eyes. In FIG. 12, the red color is the strongest, the blue color is in middle and the green color is the weakest of the three.

Even though the light-emitting units of the exemplary flashlight 60 are red, green and blue color LEDs, it should be understood that the number and wavelength of the light-emitting units can be changed to other values. And they can be other solid-state light-emitting devices instead of LED. Based on the structure of the disclosed apparatus and the method of operating the same, the spectrum of the output light can be controlled as a synthetic spectra comprising the individual spectrums with different weight.

Figure 13:
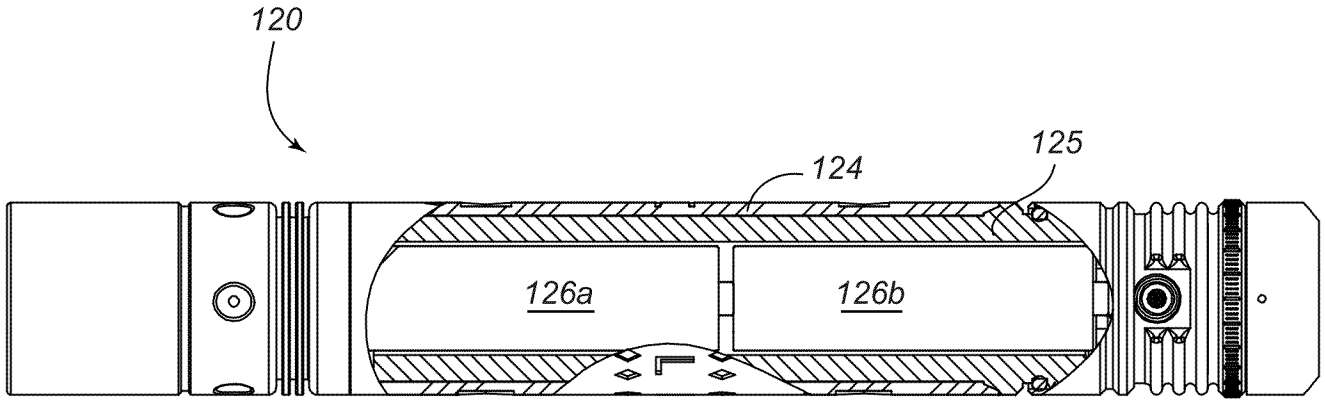
FIG. 13 is a cutaway side view of an alternative embodiment of the invention.

FIG. 13 is a cutaway side view of an alternative embodiment of the flashlight with spectrum control means. A flashlight 120 has almost all the same components as the exemplary flashlight 60 but uses 2 AA batteries 126*a*, 126*b* as power source. And it has the longer housing 125 and sleeve 124. The flashlight 120 can be operated by the similar method as illustrated for the embodiment 60.

It should be understood that the embodiments 60 and 120, the disclosed circuits and operating methods are all exemplary. The invention also covers flashlights with other light sources such as infrared or ultraviolet, with other power sources, such as AAA battery, rechargeable batteries, etc. and it also covers other portable light categories, such as lantern, headlamp, bicycle light, etc.

What is claimed is:

1. A portable light, comprising:

a light source which includes multiple light-emitting units, a power source, peripheral components which includes at least a switch, a control circuit, a light-mixing member, and a housing, whereby the control circuit responds to the user's action on the peripheral components and send electrical signals to the light source to produce different output light with a spatially-uniform synthetic spectra, whereby all the light-emitting units of the light source fit in one compartment of the housing and covered by the light-mixing member.

2. The portable light of claim 1 wherein the peripheral components further include a potentiometer.

3. The portable light of claim 1 wherein the peripheral components further include a magnetic angular sensor.

4. The portable light of claim 1 is a lantern.

5. A flashlight, comprising:

a light source which includes multiple light-emitting units, a power source, peripheral components which includes a switch and a potentiometer, a control circuit, a light-mixing lens, and a housing, whereby the control circuit responds to the user's action on the peripheral components and send electrical signals to the light source to produce different output light with a spatially-uniform synthetic spectra, whereby all the light-emitting of light source fit in compartment of the housing and covered by the light-mixing member.

6. A flashlight, comprising:

a light source which includes multiple light-emitting units, a power source, peripheral components which includes a switch and a potentiometer, a control circuit, a housing, and an optical module, whereby the control circuit responds to the user's action on the peripheral components and send a electrical signals to the light source to produce different output light with a uniform synthetic spectra, whereby the optical module comprises a protective lens which is made from transparent material, a light-mixing member from which the exiting light has spatially consistent spectrum, and a light projection unit which condenses and projects the output light to the said lens.

7. The flashlight of claim 6 wherein the light-mixing member is a sheet with a light diffusion layer.

8. The flashlight of claim 7 wherein the light projection unit include two reflectors, whereby one reflector fits between the said sheet and the light source, and another reflector fits between the said sheet and the protective lens.

9. The flashlight of claim 8 wherein the control circuit includes a power management module, a micro controller and a driving circuit.

10. The flashlight of claim 9 further including a button and a knob, whereby the button is aligned with the said switch in the manner that action on the button is directly transferred to the switch, the knob is engaged with the adjusting shaft of the potentiometer in the manner that rotation of the knob is rigidly transferred to the potentiometer, the button and the knob fit on the outside of the said housing.

11. The flashlight of claim 10 wherein a plurality of light-emitting units are one red, one green and one blue LED chip.

12. The flashlight of claim 11 wherein the said housing has a head end and a tail end, whereby the protective lens, sheet, reflectors and light source fit at the head end, the button and knob fit at the tail end, and the power source fits between the head end and the tail end.

13. The flashlight of claim 12 wherein the control circuit includes one circuit board and one circuit assembly, whereby the circuit board is connected to the light source at the head end, the circuit assembly is connected to the switch and the potentiometer at the tail end.

14. The flashlight of claim 13 wherein the circuit assembly includes two circuit boards and four pillars that connects the two circuit boards both mechanically and electrically.

15. The flashlight of claim 14 wherein the power source is one CR123 lithium battery.

16. The flashlight of claim 14 wherein the power source is two AA batteries.

17. The flashlight of claim 6 wherein the light-mixing member is a fly-eye lens.

18. The method for operating a flashlight of claim 6 wherein flashlight can be manually switched between full color mode and white light mode, and whereby in full color mode the light output can be adjust to any color on CIE chromaticity diagram, whereby in white light mode the brightness and color temperature of the output light can be adjusted.

19. The method of operating a flashlight in claim 18 whereby the color and brightness of the output light vary real-time while the user is applying adjustment, the output light shows temporary patterns to indicate the working mode and status of the control circuit.

* * * * *